US006090013A

United States Patent [19]

Eschenbach

[11] Patent Number: 6,090,013

[45] Date of Patent: Jul. 18, 2000

[54] CROSS TRAINER EXERCISE APPARATUS

[76] Inventor: Paul William Eschenbach, 143 Lakeland Ave., Moore, S.C. 29369

[21] Appl. No.: 09/206,927

[22] Filed: Dec. 7, 1998

[51] Int. Cl.[7] ..... A63B 22/04

[52] U.S. Cl. ..... 482/52

[58] Field of Search ..... 482/51, 52, 53, 482/57, 70, 79, 80

[56] References Cited

U.S. PATENT DOCUMENTS

| | | | |
|---|---|---|---|
| 5,242,343 | 9/1993 | Miller | 482/57 |
| 5,279,529 | 1/1994 | Eschenbach | 428/57 |
| 5,383,829 | 1/1995 | Miller | 482/57 |
| 5,653,662 | 8/1997 | Rodgers | 482/51 |
| 5,692,994 | 12/1997 | Eschenbach | 482/51 |
| 5,836,854 | 11/1998 | Kuo | 482/52 |

*Primary Examiner*—Stephen R. Crow

[57] ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet.

Cross trainers guide the feet along a generally elliptical shaped curve to simulate the motions of jogging and climbing. Existing machines often produce user problems such as heel slap, numb toe and knee soreness with extended use. The present invention is an improved elliptical exercise machine capable of extended exercise with fewer user problems. Further, the cross trainer is adjustable to vary the motion of the elliptical stride to accommodate users of different size and muscle development.

A non-aligned foot support member is guided by a rocker linkage on one end and driven by a crank on the other end. The resulting pedal motion has equivalent maximum horizontal forward and rearward velocities to minimize pedal accelerations that cause undue muscle and joint soreness. The non-aligned foot support member further reduces excessive pedal articulation and facilitates shrouding of the rocker linkage. Handles are coupled to the rocker linkage with adjustable connector links.

18 Claims, 4 Drawing Sheets

CROSS TRAINER EXERCISE APPARATUS

BACKGROUND OF THE INVENTION

1. Field

The present invention relates to a standup exercise apparatus that simulates walking, jogging and climbing with arm exercise. More particularly, the present invention relates to an exercise machine having separately supported pedals for the feet and arm exercise coordinated with the motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Existing machines often produce user problems such as heel slap, numb toe and knee soreness with extended use. There is a need for an improved elliptical exercise machine capable of extended exercise with fewer user problems. Further, there is a need to adjust the motion of the elliptical stride to accommodate users of different size and muscle development.

Numerous combinations of levers and cranks to combine exercise for arms and feet can be found. Hex in U.S. Pat. No. 4,645,200 combines arm and foot levers for sit down exercise while Bull et al. in U.S. Pat. No. 4,940,233 combines arm and foot levers for standup exercise.

Lucas et al. in U.S. Pat. No. 4,880,225 offer oscillating arm levers coupled to the foot crank by a connecting rod. Dalebout et al. in U.S. Pat. Nos. 4,971,316 and 5,000,444 also shows oscillating swing arms coupled to the foot crank by an offset second crank and connecting rod. Lom in U.S. Pat. No. 4,986,533 offers oscillating arms driven by a crank-slider coupled to a foot crank.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. No. 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting.

Standup pedal exercise is shown in U.S. Pat. No. 4,643,419 (Hyde) and by the DP Air Strider as previously sold by Diversified Products of Opelika,AL where pedal platforms move by dual crank motion but remain parallel to the floor. Knudsen in U.S. Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. Nos. 5,279,529 and 5,692,994. All of these exercise machines use pedals on having two pedal pivots which are guided by a first circular guide path curve generated by a crank which rotates through one full revolution during a pedal cycle and a second arc guide path curve generated by a rocker link or track.

Recently, numerous elliptical exercise machines have appeared in the patent literature. Rogers,Jr. in U.S. Pat. Nos. 5,527,246, 5,529,555, 5,540,637, 5,549,526, 5,573,480, 5,591,107, 5,593,371, 5,593,372, 5,595,553, 5,611,757, 5,637,058, 5,653,662 and 5,743,834 shows elliptical pedal motion by virtue of various reciprocating members and geared linkage systems. Miller in U.S. Pat. Nos. 5,518,473, 5,562,574, 5,611,756, 5,518,473, 5,562,574, 5,577,985, 5,755,642 and 5,788,609 also shows elliptical pedal motion using reciprocating members and various linkage mechanisms along with oscillating guide links with control links to determine pedal angles.

The Elliptical Cross Trainer by Life Fitness of Franklin Park Ill., recently introduced to the Club Industry in San Francisco during April, 1997, also generates elliptical pedal motion using an elongated pedal supported by rollers on one end and an offset crank mechanism on the other end.

Chang in U.S. Pat. No. 5,803,872 and Yu et al. in U.S. Pat. No. 5,800,315 show a pedal supported by a rocker link and driven with a pair of links located under the pedal pivotally connected to a crank. Maresh et al. in U.S. Pat. No. 5,792,026 show a foot support member supported by a rocker link and driven by a double crank mechanism. Chen in U.S. Pat. No. 5,779,599 shows a foot support member supported by a rocker and crank roller being driven by a coupler link. Lee in U.S. Pat. No. 5,779,598 shows a pedal link driven by two separate cranks.

Cheng in U.S. Pat. No. 5,759,136 shows a foot support member with a movable pedal for adjustable elliptical motion. Lee in U.S. Pat. No. 5,746,683 shows a foot support member supported on one end with a compound rocker wherein a slider and handle lever support the rocker. Kuo in U.S. Pat. No. 5,836,854 offers a linear foot support member connected on one end to a crank and guided along an arcuate curve under the pedal by a linkage on the other end. None of the above prior art deals adequately with the quality of pedal motion needed for enduring exercise without muscle soreness.

It is one objective of this invention to provide improved elliptical foot motion. Another object of this invention is to coordinate arm motion with pedal motion.

There is a need for a pedal operated cross trainer exercise apparatus that can be safely operated without undue muscle or joint soreness in the standup position whereby the arms and legs can be exercised with the feet moving through a generally elliptical path while the pedals move with a smoothly changing angular motion during the pedal cycle.

SUMMARY OF THE INVENTION

The present invention relates to the kinematic motion control of pedals which simulate walking, jogging and climbing during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles are controlled to vary about the horizontal during the pedal cycle. Arm exercise is by arm levers coordinated with the mechanism guiding the foot pedals.

In the preferred embodiment, the apparatus includes a separate pedal for each foot, each pedal being supported by a non-aligned foot support member which is pivotally attached to a guide, which in this embodiment, is a rocker link pivoted to the framework or a movable actuator. The non-aligned foot support link is pivotally attached to a rotary crank. The crank completes one full revolution during a pedal cycle and is phased generally opposite the crank for the other non-aligned foot support link through a bearing journal attached to the framework.

The non-aligned foot support member allows the pedal to operate below the upper rocker pivot and above the lower rocker pivot connected near the lower framework. This arrangement allows the heel to be below the toe when the crank is in a lowermost position thereby reducing the pedal angle when the crank is in the uppermost position. Further, the relationship between the pedal attached to non-aligned foot support member and the rocker link promotes equivalent maximum forward and rearward pedal velocities. These improvements in pedal motion reduces heel slap and numb toe because of better pedal articulation. The knee soreness can be reduced by lowering the knee forces due to higher accelerations which occur when forward and rearward velocities are dissimilar.

Arm exercise is coordinated with the pedal motion by a pair of handles pivoted to the framework and pivotally connected to the rocker links with a connecting link. The back and forth hand motion can be lengthened or shortened depending upon where the connecting link is attached to the handle or rocker link. Adjustment of the length of the connector links will reposition the range of handle motion relative to the body. The preferred handle to pedal coordination positions the handle close to the upper body when the pedal is forward.

In an alternate embodiment, the pivot guide for the non-aligned foot support follows a generally linear path produced by a guide mechanism. The guide mechanism is a linkage comprised of a rocker link attached at the guide pivot to the non-aligned foot support member and pivotally supported by a pair of links that are pivoted to the framework. The linear guide path allows the pedal to follow an elongate curve that is very elliptical in shape. The preferred pedal articulation and pedal velocity relationship of the first embodiment remain.

Load resistance is applied to the crank in each embodiment by a pulley which drives a belt to a smaller pulley attached to an alternator and flywheel supported by the framework. In each embodiment, the flywheel must overcome the torque provided by the alternator. Adjustment of the alternator electronics provides variable intensity exercise for the operator.

The rocker pivot in the first embodiment and the rocker support link pivot in the alternate embodiment are movable relative to the frame during operation which allows reorientation of the elongate pedal motion. A more horizontal elongate curve occurs with the pivot closer to the crank to better simulate jogging. An inclined elongate curve occurs with the pivot moved further from the crank to better simulate climbing motion. The user can select the desired motion by adjustment of an actuator while in operation.

In summary, this invention provides the operator with stable foot pedal support having adjustable motions that simulate walking, jogging and climbing with very low joint impact while offering extended operation without heel slap, numb toe or knee soreness due to erratic pedal accelerations. Arm exercise is coordinated with lower body pedal motion.

DETAILED DESCRIPTION OF THE EMBODIMENTS

Figure 1:
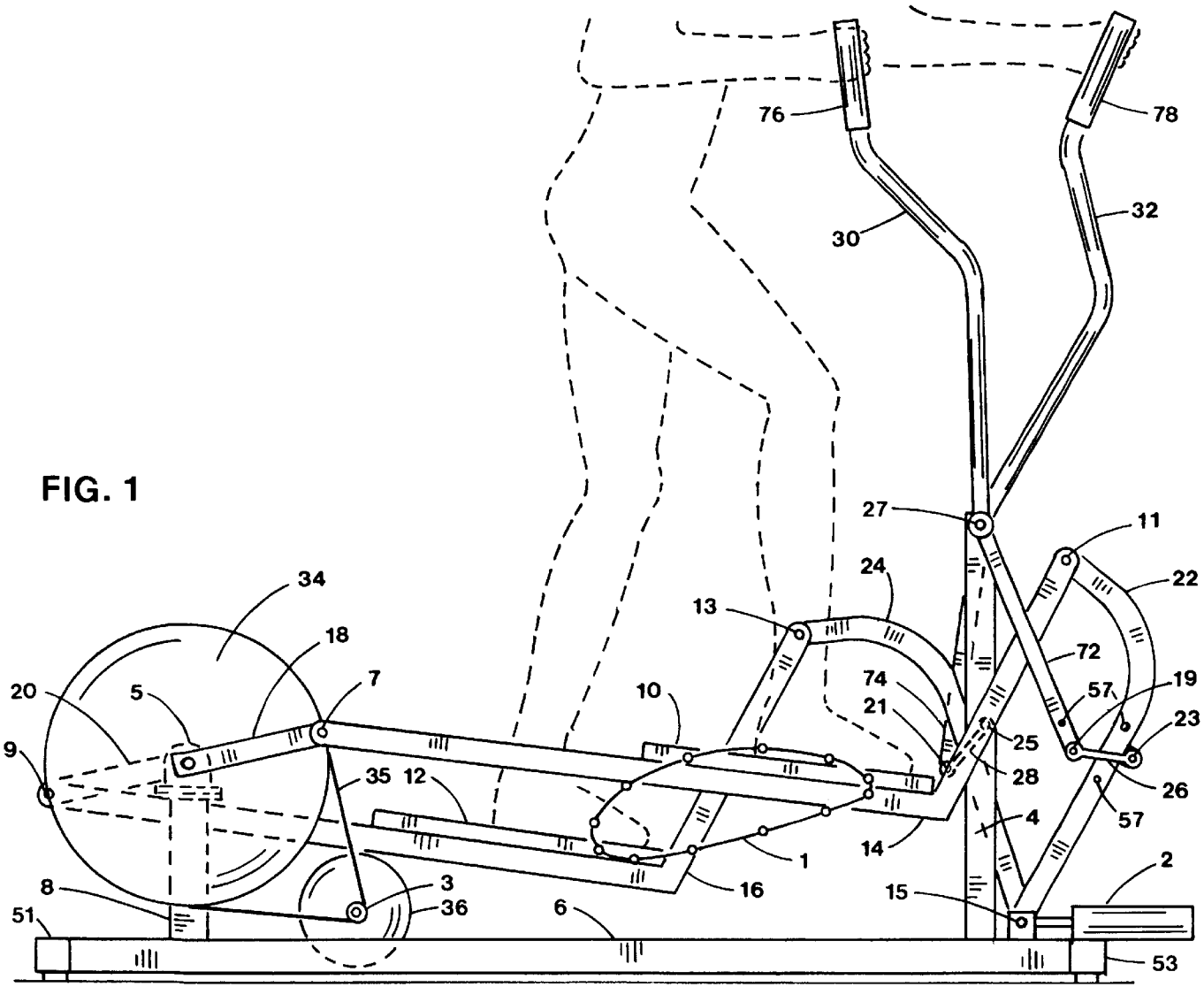
FIG. 1 is a right side elevation view of the preferred embodiment of an exercise machine constructed in accordance with the present invention.
Figure 2:
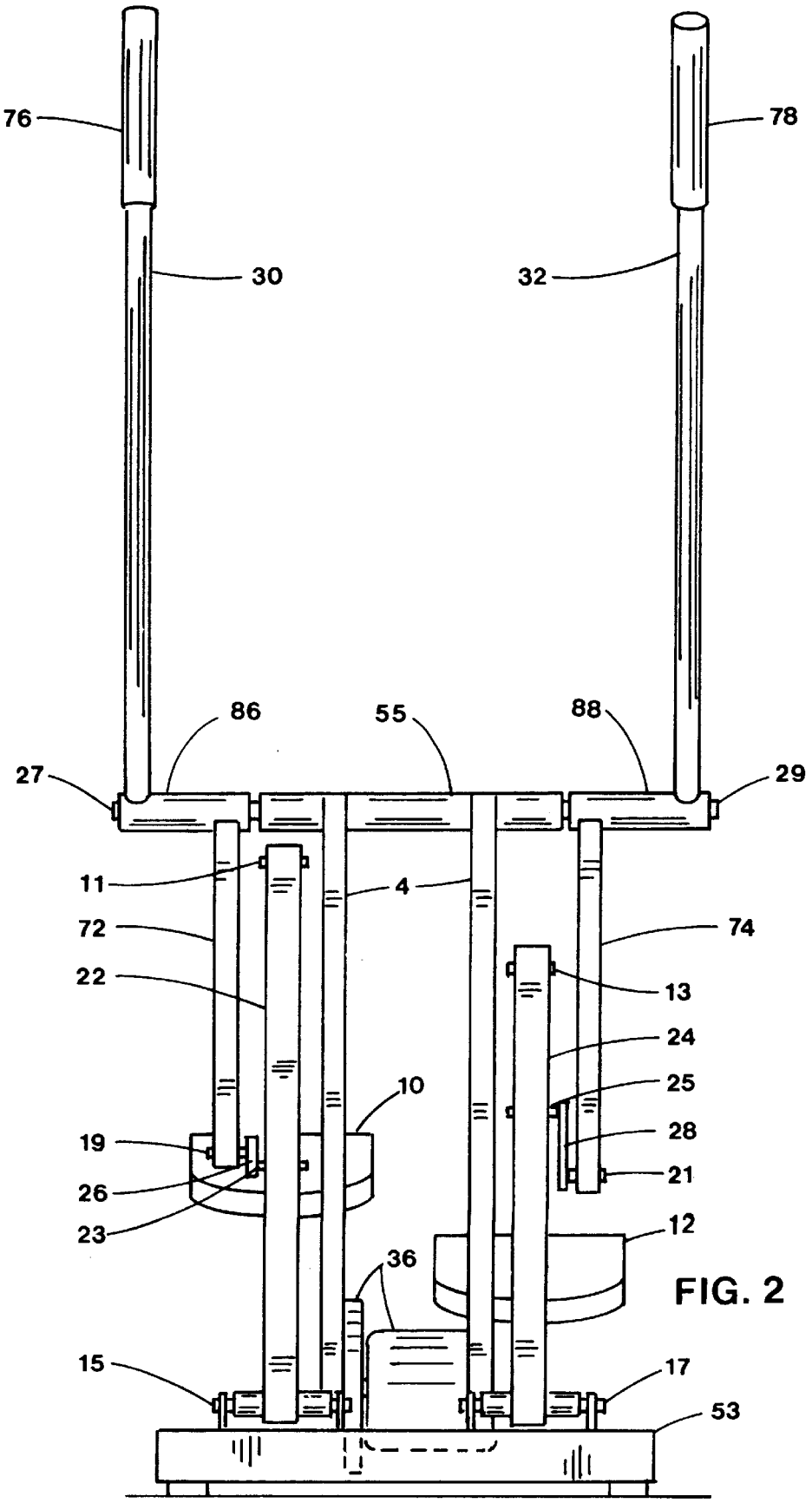
FIG. 2 is the front view of the preferred embodiment shown in FIG. 1.

Referring to the drawings in detail, pedals 10 and 12 are shown in FIGS. 1 and 2 in the most forward and rearward positions of the preferred embodiment. Pedals 10 and 12 are attached to non-aligned foot support members 14,16 which are connected to rocker links 22,24 at pivots 11,13 at one end and connected to crank arms 18,20 by pivots 7,9 at the other end. Rocker links 22,24 are connected to frame member 6 by pivots 15,17 which are moveable during operation by actuator 2. Actuator 2 is not shown in FIG. 2 for clarity.

Crank arms 18,20 are joined inside bearing housing 5 and protrude outwardly in generally opposing directions. Load resistance is imposed upon crank arms 18,20 by pulley 34 with belt 35 connected to pulley 3 on flywheel/alternator 36 which is supported by the frame member 6.

Frame member 6 connects cross members 51,53 which contact the floor for support of the exercise machine. Frame member 8 connects frame member 6 to crank bearing housing 5. Frame member 4 connects frame member 6 to frame member 55 which supports pivots 27,29.

Hand grips 76,78 and handles 30,32 are supported by pivots 27,29. Handle extensions 86,88 connect handles 30,32 to arm levers 72,74. Connector links 26,28 are attached to the arm levers 72,74 at pivots 19,20 and to rocker links 22,24 at pivots 23,25. Additional holes 57 are available to adjust the range of handle motion. Connector links 26/28 are extendible to change the length when desired. The preferred adjustment has the handle 30,32 positioned close to the upper body when the pedal 10,12 is forward.

Application of body weight on the pedals 10,12 causes the pedals 10,12 to follow elongate curve 1 shown in FIG. 1 and together with force applied at the handles 30,32 cause the linkage to rotate the flywheel/alternator 36 for a gain in momentum. This flywheel/alternator 36 momentum will carry the linkage system through any dead center positions of the crank arms 18,20. The pedals 10,20 and handles 30,32 can be operated to drive the flywheel/alternator 36 in either direction of rotation.

Figure 3:
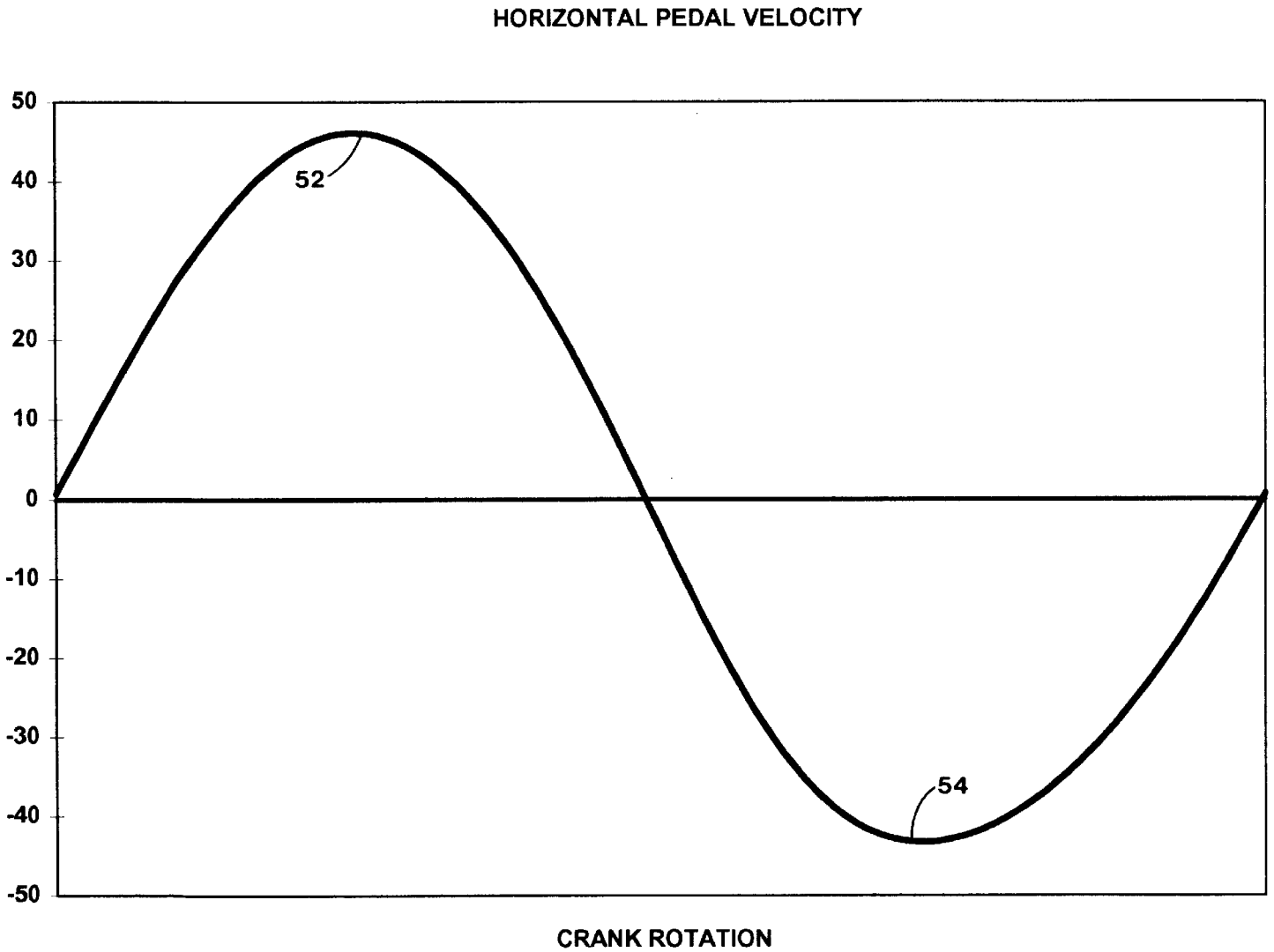
FIG. 3 is a graph of pedal velocity vs. crank rotation for the preferred embodiment.

FIG. 3 shows the velocity profile for one revolution of the crank starting with the foot in the most rearward position. The maximum forward pedal velocity 52 is approximately the same in magnitude as the maximum rearward velocity 54. Foot forces resulting from erratic pedal accelerations are minimized.

Figure 4:
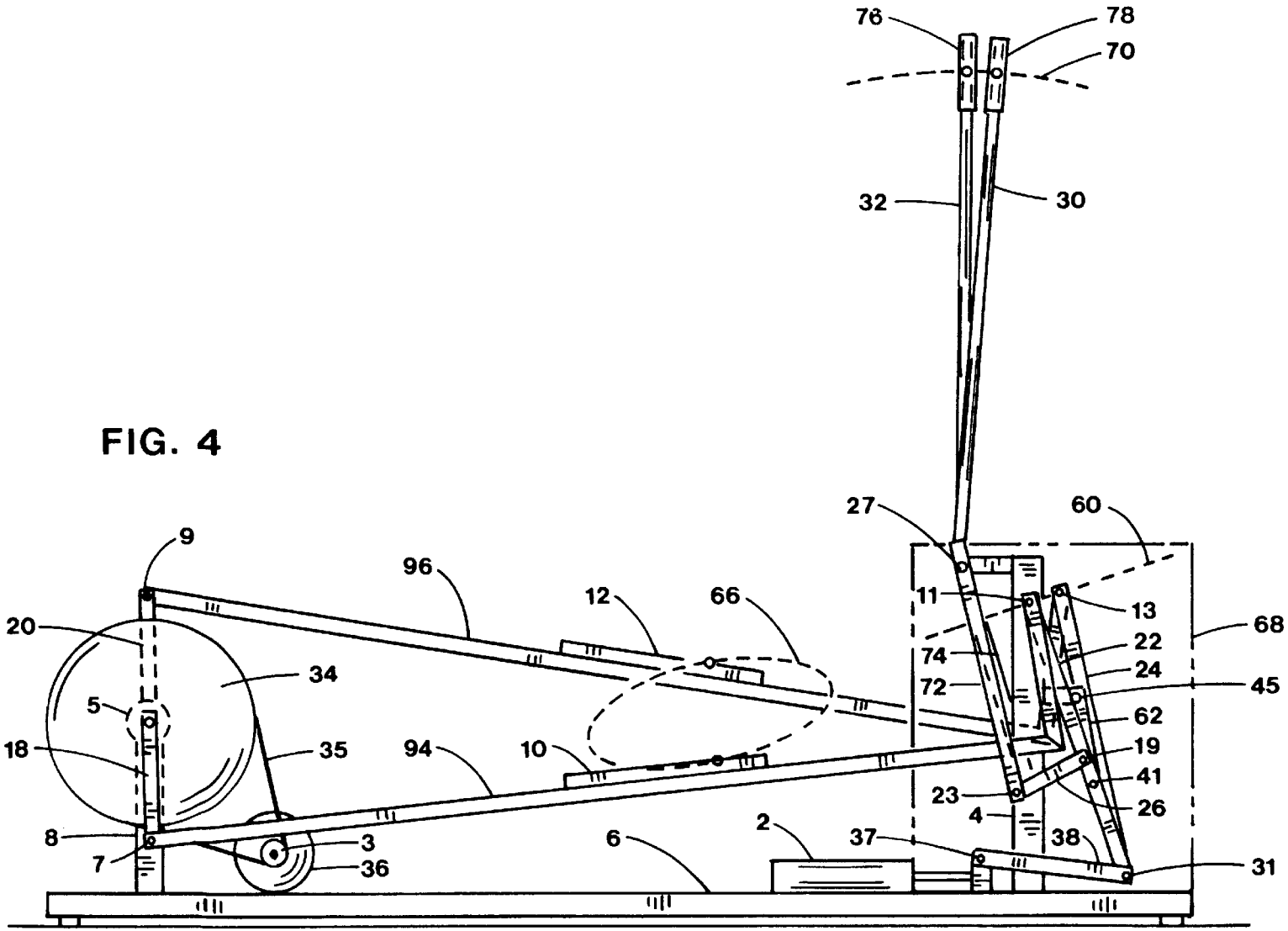
FIG. 4 is a right side elevation of the alternate embodiment.

An alternate embodiment is shown in FIG. 4, with pedals 10,12 in their lower and uppermost positions. The non-aligned foot support members 94,96 are more elongate with a right angle vertical offset to accommodate shrouding 68. Only the horizontal portion of the non-aligned foot support members 94,98 exit the shroud 68. Crank arms 18,20 and load resistance 34,35,3,36 are the same as the preferred embodiment. Rocker links 22,24 are connected to non-aligned foot support members 94,96 at pivots 11,13. Links 38,40 are connected to the ends of rocker links 22,24 at pivots 31,33 and to the frame member 6 at pivots 37,39. Pivots 37,39 are moveable during operation by actuator 2.

Links 62,64 are connected to rocker links 22,24 intermediate the ends at pivots 41,43 and to frame member 4 at pivots 45,47. The guide linkage combination of rocker links 22,24 and links 38,40,62,64 cause the guide pivots 11,13 to follow the linear curve path 60. The guide linkage operates within shroud 68.

Hand grips 76,78 and handles 30,32 are connected to frame member 55 at pivots 27,29. Handles 30,32 are coupled to arm levers 72,74 with handle extensions 86,88 and connector links 26,28 connect arm levers 72,74 to rockers 22,24 as in the preferred embodiment with adjustment features.

Application of body weight upon pedals 10,12 produces the very elliptical curve path 66 and pedal positions similar to the first embodiment. Hand grips 76,78 trace the arcuate curve 70.

In summary, the present invention has distinct advantages over prior art because the back and forth stride movement of the pedals exhibit similar velocities in forward and rearward directions. Pedal angles in the uppermost portion of the elongate curve are less severe to reduce excessive ankle articulation. Better support of the heel reduces heel slap and numb toe.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising;

a framework configured to be supported by the floor;

a crank means rotatably connected rearward the user to said framework, said crank means projecting outwardly therefrom on both sides thereof;

a pair of non-aligned foot support members, each said non-aligned foot support member pivotally connected proximate one end to said crank means;

a pair of guide means, each said guide means connected to said non-aligned foot support member at a guide pivot and operably associated with said framework; said guide means is a pair of rocker links connected to said framework by a pivot means;

a pair of pedal means to support each foot, said pedal means attached to said non-aligned foot support members distal said crank means; each said pair of rocker means pivotally connected to said non-aligned foot support member above said pedal means and operatively associated with said framework below said pedal means;

said pedal means configured to move relative to said framework when the foot of the user is rotating said crank means whereby said pedal means is positioned with the heel of the foot below the toe when said crank means is positioned in generally the lowermost portion of the pedal cycle.

2. The exercise machine according to claim 1 further comprising a means for moving said pivot means whereby the motion of said pedal means can be altered during operation of said exercise machine.

3. The exercise machine according to claim 1 wherein said guide means further comprises a linkage means whereby said guide pivot follows a generally linear path.

4. The exercise machine according to claim 3 wherein said linkage means further comprises a rocker means pivotally supported by a pair of link means, said link means pivotally attached to said framework.

5. The exercise machine according to claim 1 further comprising a load resistance means operably associated with said crank means.

6. The exercise machine according to claim 1 further comprising a pair of handle means, each said handle means pivotally connected to said framework means and;

a pair of connector links, each said connector link pivotally attached to said handle means and operably associated with said guide means.

7. The exercise machine according to claim 1 wherein said pedal means follows an elongate curve whereby the maximum forward velocity is generally the same as the maximum rearward velocity.

8. An exercise machine comprising;

a framework configured to be supported by the floor;

a crank means rotatably connected rearward the user to said framework, said crank means projecting outwardly therefrom on both sides thereof;

a pair of elongate non-aligned foot support members, each said elongate non-aligned foot support member pivotally connected proximate one end to said crank means;

a pair of pedal means to support each foot, said pedal means attached to said non-aligned foot support members distal said crank means;

a pair of rocker means, each rocker means pivotally connected to said non-aligned foot support member above said pedal means and operably associated with said framework below said pedal means;

said pedal means configured to move relative to said framework when the foot of the user is rotating said crank means wherein said pedal means follows an elongate curve whereby the maximum forward velocity of said pedal means is generally the same as the maximum rearward velocity.

9. The exercise machine according to claim 8 wherein said connector link means is adjustable to reposition the location of said handle means relative to the user.

10. The exercise machine according to claim 8 wherein said non-aligned foot support member further comprises an elongate horizontal section and a vertical section connected at generally right angles whereby only said elongate horizontal section of said non-aligned foot support member exits a shroud.

11. The exercise machine according to claim 8 wherein said rocker means further comprises a pivot means operably associated with said framework and a means for moving said pivot means whereby the motion of said pedal means can be altered.

12. The exercise machine according to claim 8 wherein said rocker means further comprises a rocker link pivotally supported by a pair of link means, said link means pivotally attached to said framework.

13. An exercise machine comprising;

a framework configured to be supported by the floor;

a crank means rotatably connected rearward the user to said framework, said crank means projecting outwardly therefrom on both sides thereof;

a pair of non-aligned foot support members, each said non-aligned foot support member pivotally connected proximate one end to said crank means;

a pair of pedal means to support each foot, said pedal means attached to said non-aligned foot support member distal said crank means;

a pair of rocker means, each rocker means pivotally connected to said non-aligned foot support member above said pedal means and operably associated with said framework below said pedal means;

a pair of handle means, each said handle means pivotally connected to said framework;

a pair of connector links, each said connector link pivotally attached to said handle means and pivotally attached to said rocker means;

said handle means coordinated with said pedal means to move relative to said framework when the foot of the user is rotating said crank means whereby said handle means is positioned proximate the upper body when said pedal means is positioned forward the user.

14. The exercise machine according to claim 13 wherein said rocker means further comprises a rocker link pivotally supported by a pair of link means, each said link means pivotally attached to said framework.

15. The exercise machine according to claim 13 wherein said rocker means further comprises a pivot means operably associated with said framework and a means for moving said pivot means whereby the motion of said pedal means can be altered.

16. The exercise machine according to claim 13 wherein said pedal means is positioned with the heel of the foot below the toe when said crank means is positioned in generally the lowermost portion of the pedal cycle.

17. The exercise machine according to claim 13 wherein said pedal means follows an elongate curve whereby the maximum forward velocity is generally the same as the maximum rearward velocity.

18. The exercise machine according to claim 14 wherein at least one of said link means has a pivot means operably associated with the framework whereby said pivot means is movable by an actuator during operation of said exercise machine to change the motion of said pedal means.

* * * * *